United States Patent [19]

Davidson et al.

[11] 4,156,539

[45] May 29, 1979

[54] MEDICAL CONDITION INDICATING DEVICE FOR ATHLETES AND THE LIKE

[75] Inventors: Maxine J. Davidson; Keith M. Davidson; Orville Ottenbreit, all of Assiniboia; Tony Stobart, 127A - 2nd St. N., Weyburn, all of Canada

[73] Assignees: Wayne G. Squires; Tony Stobart, both of Weyburn, Canada

[21] Appl. No.: 896,775

[22] Filed: Apr. 17, 1978 (Under 37 CFR 1.47)

[51] Int. Cl.[2] ..... B42D 15/00

[52] U.S. Cl. ..... 283/7

[58] Field of Search ..... 283/7, 21, 61, 62

[56] References Cited

U.S. PATENT DOCUMENTS

| | | | |
|---|---|---|---|
| 2,321,184 | 6/1943 | Butterworth | 283/7 |
| 3,921,318 | 11/1975 | Calavetta | 283/7 |

*Primary Examiner*—Gerald A. Dost

*Attorney, Agent, or Firm*—Stanley G. Ade

[57] ABSTRACT

An identification card is provided with use by athletes and sportsmen, particularly younger athletes and sportsmen and which includes identification of the user and perforated sections for selective removal from the card. Each section indicates a medical problem such as a Diabetic, Allergy, Internal Mouthpiece and the like. The card and the removable sections are provided with pressure sensitive adhesive on the back thereof initially covered with a removable paper shield. In use, the user fills out his name and address, etc. and then, in one embodiment, removes and discards the perforated sections not applicable to him, removes the paper shield and adhesively secures the remaining portion of the card to his clothing at the shoulder or other convenient location. In another embodiment, certain perforated sections can be removed and discarded or, if required, adhesively secured to the clothing above the identification portion to indicate his disabilities. In both embodiments, the medical condition or disability is indicated to other personnel if by chance, he is unable to communicate due to accident, disability or the like.

3 Claims, 4 Drawing Figures

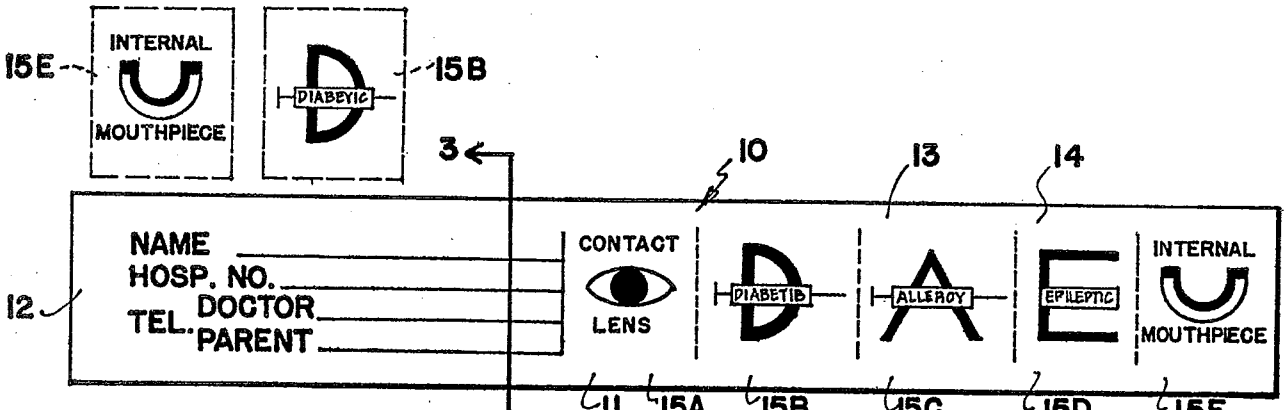
FIG. 1
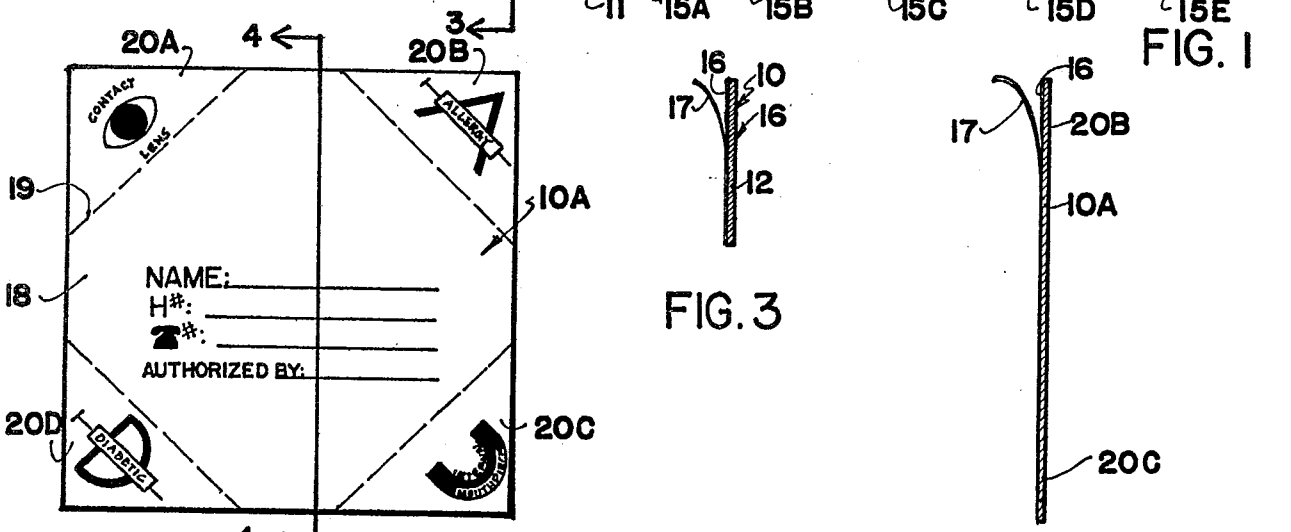
FIG. 2
FIG. 3
FIG. 4

MEDICAL CONDITION INDICATING DEVICE FOR ATHLETES AND THE LIKE

BACKGROUND OF THE INVENTION

This invention relates to new and useful improvements in medical condition indicating devices and it is particularly suitable for use by young athletes or sportsmen so that anyone can tell at a glance, the disability or medical condition existing. It is particularly useful when the wearer is not able to communicate his disability or condition due either to accident or the onslaught of the condition itself.

For example, a child may well be suffering from diabetes or epilepsy and under normal circumstances could communicate this fact if necessary. However, if the condition produces an effect which prevents the child or user user from communicating his disability or condition, a glance at the present device will inform of his condition or disability so that the necessary treatment can be given or obtained.

Although the device is designed for use particularly with children engaged in sports or athletes, nevertheless, of course, it can be used by adults and either by adults or children whether or not they are engaged in sports or athletics.

SUMMARY OF THE INVENTION

One aspect of the invention therefore comprises a medical condition indicating device comprising a card having a main identification portion bearing identification indicia thereon and having a plurality of perforated, selectively detachable portions each bearing identification of a medical problem thereon, said card and said selectively detachable portions having pressure sensitive adhesive on the rear side thereof and a detachable paper shield covering said pressure sensitive adhesive.

Another aspect of the invention is to provide a device of the character herewithin described which enables the device to be secured to the clothing of the wearer adjacent the shoulder or other convenient location and which, by selective removal and discarding of portions not applicable, provides instant identification of the user, his telephone number and addresses, if necessary or desired, and the medical problem or condition suffered by him.

Another aspect of the invention is to provide a device of the character herewithin described which is simple in operation, economical in manufacture, and otherwise well suited to the purpose for which it is designed.

With the foregoing in view, and other advantages as will become apparent to those skilled in the art to which this invention relates as this specification proceeds, our invention consists essentially in the arrangement and construction of parts all as hereinafter more particularly described, reference being had to the accompanying drawings in which:

DESCRIPTION OF THE DRAWINGS

FIG. 1 is a front elevation of the preferred embodiment of the device.

FIG. 2 is a front elevation of an alternative embodiment of the device.

FIG. 3 is a cross sectional view along the line 3—3 of FIG. 1.

FIG. 4 is a cross sectional view along the line 4—4 of FIG. 2.

In the drawings like characters of reference indicate corresponding parts in the different figures.

DETAILED DESCRIPTION

Proceeding therefore to describe the invention in detail, reference character 10 illustrates the preferred embodiment which comprises an elongated, substantially rectangular paper or cardboard strip 11 having an end portion 12 which bears indicia useable for the identification of the user such as his name, his hospital number, and the telephone numbers of his doctor and parents if desired.

However, it will be appreciated that other or alternative identification indicia may be provided if desired.

Situated upon one side of the end portion 12 is a plurality of panels 13 in side by side relationship and formed by the provision of transversely situated lines of perforations 14 in spaced and parallel relationship along the remainder of the card or paper strip 10.

These lines of perforation define individual panels 15A through 15E and although five such panels are illustrated in FIG. 1, it will of course be appreciated that more or less panels may be provided if desired.

Each panel indicates a medical problem or condition both graphically and pictorially.

For example, panel 15A indicates contact lens are being worn, 15B indicates a diabetic condition, and 15C illustrates an allergy condition. Panel 15D indicates an epileptic condition and 15E indicates that the wearer is using an internal mouthpiece.

These are exemplary only and, of course, other or different conditions can be indicated if desired.

The strip 10 is provided with pressure sensitive adhesive 16 on the rear side thereof and a detachable paper or synthetic plastic shield 17 normally covers and protects the pressure sensitive adhesive.

In use, the user fills in the identification material on the end portion 12 of the strip and then depending upon the conditions or problems from which he suffers, can tear off certain of the panels 15 as necessary.

For example, if he wears contact lens and is a diabetic then all that is necessary is to remove the other three panels by tearing along the perforated line between panels 15B and 15C whereupon the paper shield 17 is removed and the remainder of the device is adhesively secured to his outer clothing as for example, near the shoulder or other convenient location.

If, however, for example, he suffers from an allergy and wears an internal mouthpiece, then these two panels should be torn from the remainder with panels 15A, 15B and 15D being discarded.

The identification portion 12 is then adhesively secured to his clothing and the two relevant panels 15C and 15E are adhesively secured to his clothing immediately above the identification portion 12 as shown in FIG. 1 thus enabling anyone to identify the medical problem or condition.

In the embodiment shown in FIG. 2, the card or device is substantially rectangular and is identified by reference character 10A. The central portion 18 is utilized for the identification portion and lines of perforations 19 extend diagonally adjacent each corner thus defining the corner panels 20A, 20B, 20C and 20D. These corner panels each contain graphic and printed indicia identifying the medical problem or condition.

Once again the rear side of this panel or device 10A is provided with pressure sensitive adhesive 16 with a detachable paper or synthetic plastic shield 17 protecting same until it is used.

In this particular device, the corners bearing the medical problem or condition that are not applicable are torn off along the lines of perforation and discarded and the remainder of the panel is then adhesively secured to the clothes of the wearer as hereinbefore described.

It is desirable but not necessary that the side of the panels 10 or 10A bearing the indicia be colored a bright red or fluorescent color so that they are readily seen by an observer if injury or illness occurs to the wearer.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. A medical condition indicating device comprising a card having a main identification portion bearing identification indicia thereon and a plurality of perforated selectively detachable portions each bearing identification indicia of a medical problem thereon, said card and selectively detachable portions having pressure sensitive adhesive on the side opposite to the indicia bearing side and a detahable paper shield covering said pressure sensitive adhesive.

2. The invention according to claim 1 in which said card is substantially rectangular when viewed in front elevation, said selectively detachable portions being situated one at each corner of said card, and lines of perforations extending diagonally across each corner defining each offset selectively detachable portions.

3. The invention according to claim 1 in which said card is substantially rectangular when viewed in front elevation, said main identification portion being situated at one end thereof, said selectively detchable portion being serially located in a position extending from one side of said one end and in side by side relationship and separated one from the other by transverse lines of perforation in spaced and parallel relationship one with the other.

* * * * *